United States Patent [19]

Mangin et al.

[11] Patent Number: 4,595,045

[45] Date of Patent: Jun. 17, 1986

[54] METHOD AND DEVICE FOR SUPPLYING AND CONTROLLING THE LAYER OF FLUX POWDER IN A CONTINUOUS CASTING MOLD

[75] Inventors: Michel Mangin, Fameck; Patrick Bardet, Uckange, both of France

[73] Assignee: Societe Lorraine de Laminage Continu-Sollac (Societe Anonyme), Paris, France

[21] Appl. No.: 470,479

[22] Filed: Feb. 28, 1983

[30] Foreign Application Priority Data

Mar. 5, 1982 [FR] France ..... 82 03771

[51] Int. Cl.[4] ..... B22D 11/07

[52] U.S. Cl. ..... 164/472; 164/268

[58] Field of Search ..... 164/472, 473, 268, 459

[56] References Cited

U.S. PATENT DOCUMENTS

| | | | |
|---|---|---|---|
| 3,167,442 | 1/1965 | Brooks | 118/415 |
| 3,411,566 | 11/1968 | Astrov et al. | 164/473 X |
| 3,517,727 | 6/1970 | Babel | 164/473 X |
| 4,040,470 | 8/1977 | Fastner | 164/473 |
| 4,116,367 | 9/1978 | Kataoka et al. | 164/472 X |
| 4,165,780 | 8/1979 | Engeler | 164/473 |

FOREIGN PATENT DOCUMENTS

| | | |
|---|---|---|
| 2231456 | 12/1974 | France . |
| 2432353 | 2/1980 | France . |
| 2456689 | 12/1980 | France . |

*Primary Examiner*—Nicholas P. Godici

*Attorney, Agent, or Firm*—Scully, Scott, Murphy & Presser

[57] ABSTRACT

In order to supply and control the deposit, on the surface of the metal bath of a continuous casting mold, of an evenly distributed layer, of predetermined thickness, of a powdery or granulated material, by way of a supply conduit whose end portion is provided with a delivery nozzle situated above the surface of said metal bath. The delivery nozzle is situated above the surface of the metal bath, at a height equal to or slightly more than the predetermined thickness, the said delivery nozzle is permanently open, and the end portion of the supply conduit is permanently supplied with the said material.

9 Claims, 8 Drawing Figures

2
9
2a
8
1
4'
3
5a
5b
5
6
7
6
7

9
2a
4
4'
1
8
5b
3
5a
Δ
e

METHOD AND DEVICE FOR SUPPLYING AND CONTROLLING THE LAYER OF FLUX POWDER IN A CONTINUOUS CASTING MOLD

BACKGROUND OF THE INVENTION

The invention relates to the continuous casting of metals and in particular of steel.

More specifically, the invention relates to a supply and control method for depositing on the surface of the metal bath in a continuous casting mold, an evenly distributed layer, of predetermined thickness, of a powdery or granulated material, said method being of the type wherein the surface of the metal bath is supplied by gravity with said material by way of a supply conduit whose end portion is provided with a delivery nozzle situated above the surface of said metal bath.

The invention also relates to the device used for carrying out said method.

During continuous casting, the steel bath inside the mold is permanently covered with a layer of powdery or granulated material, designated hereinafter as the powder. The object of this powder is to heat-insulate the bath, to prevent the metal from re-oxidizing, to absorb floating inclusions, and finally to lubricate the walls of the mold. The powder is liquefied into slag when in contact with the liquid metal and the walls of the mold become coated with said slag when said mold oscillates upwardly. Each oscillating movement therefore means a reduction in the quantity of slag on the metal bath, this resulting in a reduction of the thickness of the layer of powder. The powder supplied to compensate for the powder consumed varies in relation to the characteristics of that powder, to those of the casting machine, to the working conditions of said machine as well as to the characteristics of the cast metal. The four functions of the powder are, in practice, optimized by keeping a constant thickness of the layer covering the metal bath. The height of said layer can be adjusted by hand or automatically. An automatic method has been found to ensure a more reliable operation, safer working conditions, a better quality of the molded products, and a reduction in staff costs.

Automatic installations are already known, from French Pat. Nos. 2 231 456 and 2 432 353, for spreading out powder and controlling the thickness of the formed layer, in which the supply of powder designed to compensate for the powder consumption is initiated by a detection of absence of powder or reduction of the thickness of the powder layer. Sensors with associated electric and electronic equipments are used to this effect, these equipments processing the signals of the sensors and controlling, by delayed action, mechanized quantity-measuring and supplying devices to restore the predetermined thickness of the powder. Automatic installations of this type have the disadvantage however of not keeping a constant thickness of powder. The preset and irregular compensations indeed lead to repeated overconsumptions or shortages of powder. Their reliability is doubtful due to a multiplication of the risks of failure in the relatively sophisticated equipments which have to be used. Another disadvantage is their high purchase and operating costs.

SUMMARY OF THE INVENTION

It is the object of the present invention to overcome the disadvantages of the known methods and devices by proposing a control and supply method and device permitting to follow the powder consumption in an instantaneous and continuous manner, by using simple and inexpensive devices, which are also cheap to operate.

This object is reached according to the invention by:

positioning the delivery nozzle of the end portion of the supply conduit above the surface of the metal bath, at a height equal to, or slightly more than the predetermined thickness of the powder layer;

keeping the said delivery nozzle permanently open;

permanently supplying powder to the said end portion of the supply conduit.

The invention also relates to a device permitting to carry out the aforesaid method, due to the fact that:

the delivery nozzle is situated above the surface of the metal bath, at a height equal to or slightly more than the predetermined thickness;

said delivery nozzle is permanently open;

the device comprises means for keeping the end portion of the supply conduit permanently supplied with powder.

BRIEF DESCRIPTION OF THE DRAWINGS

The invention will be more readily understood on reading the following description, with reference to the accompanying drawings, in which.

DETAILED DESCRIPTION OF THE PREFERRED EMBODIMENTS

Figure 1:
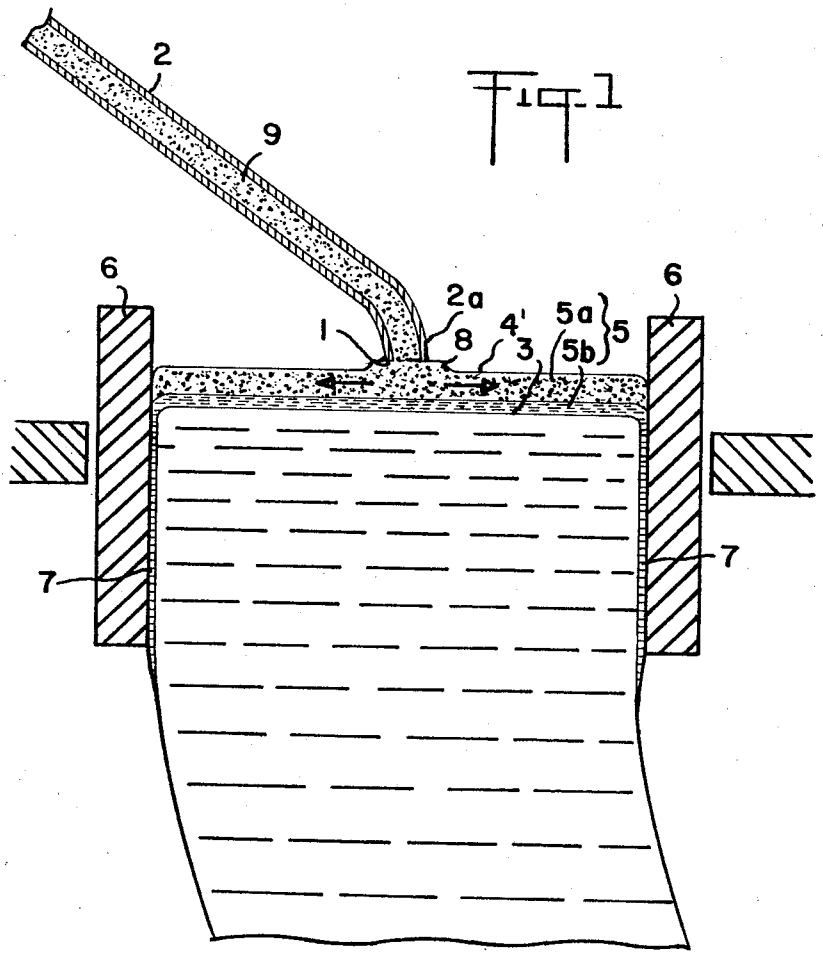
FIG. 1 is a diagrammatical cross-section of a continuous casting mold equipped with the device for carrying out the invention.

According to the invention the supply of powdery or granulated material to compensate for the consumption and keep the thickness of the powder layer constant is initiated directly by the tendency to collapse of the upper level of said layer, in the immediate vicinity of the delivery of the final supply conduit, said conduit being permanently supplied. Said supply is stopped whenever the upper level of the powder layer reaches the level of the outlet.

The method according to the invention is performed by positioning the delivery nozzle 1 of the end section 2*a* of the supply pipe 2 above the level 3 of the metal bath (said level 3 being used as reference since it is kept as constant as possible for the good operation of the continuous casting) at a level 4 which is equal or slightly more than the predetermined thickness e or level 4' of the layer 5 of solid 5*a* and liquefied 5*b* powder. The nozzle 1 is preferably placed at equal distance from the longitudinal walls 6 of the casting mold and at an adequately selected distance from the transversal walls not shown. The discharge in 7 of the liquefied powder 5*b*, designated hereinafter as slag, by lubrication of the walls 6 of the mold, causes a displacement of the slag layer towards the walls of the mold, in the direction shown by the arrows. The metal turbulences caused by the casting nozzles (not shown) also induce the said slag layer displacement in the indicated direction.

The slag, by flowing in the indicated direction, carries with it the upper part of the powder layer not yet liquefied. Said powder displacement, as well as the continuous liquefaction of the powder as the already liquefied part thereof is consumed, lowers the upper level of the powder layer under the delivery nozzle 1, thus uncovering a space under said nozzle 1. According to the invention, said space is instantaneously filled by the gravity downflow of a quantity of powder forming a mound such as 8 which stops the downflow of powder when the top of the mound reaches the delivery nozzle 1. Said mound, by progressively spreading, uncovers then another space under the delivery nozzle 1. Said space causes another downflow of powder which once again spreads into a mound.

Figure 2:
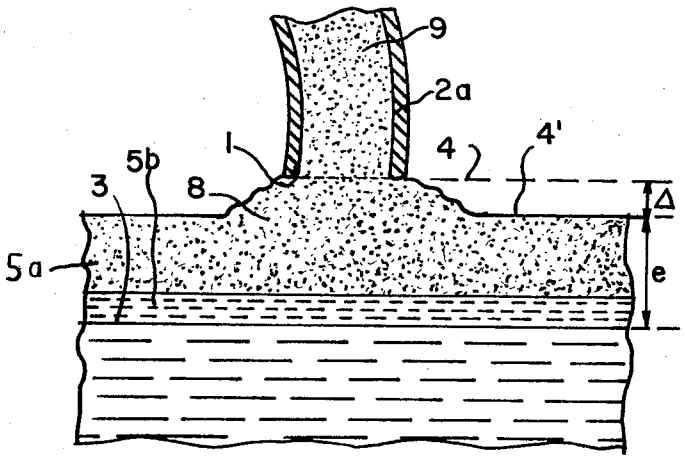
FIG. 2 is an enlarged view of part of FIG. 1, showing the mound created by the dropping powder and the stoppage of the supply when the top of said mound has reached the level of the filling orifice.

Theoretically, under frictionless conditions, the powder supply would be continuous and the level 4 (FIG. 2) of the delivery nozzle 1 would coincide with the level 4' of the surface of the powder layer 5, and, strictly speaking, there would not be any mound.

In actual fact, the level 4 of the delivery nozzle 1 is raised with respect to the level 4' by a value Δ. Said value Δ, which is very small and forms the height of the mound 8, varies with the flowing characteristics of the powders used.

Figure 3:
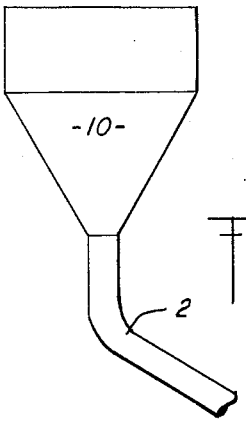
FIG. 3 is a schematic drawing showing a hopper for supplying powder to the powder supply pipe shown in FIG. 1.
Figure 4:
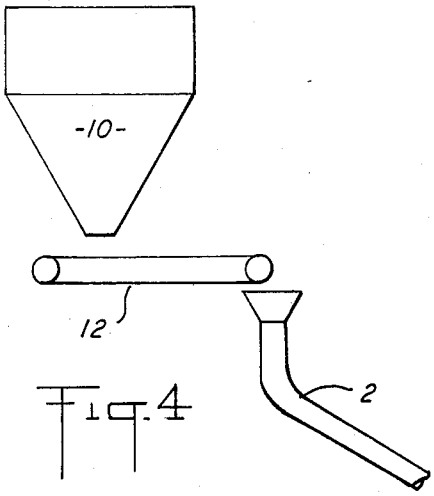
FIG. 4 is a schematic drawing showing a hopper and conveyor means for supplying powder to the powder supply pipe shown in FIG. 1.

The other end of the supply pipe 2 is connected to a hopper 10 (shown in FIGS. 3 and 4). Said hopper is placed above the casting level and supplies powder 9 by gravity to the supply pipe 2. In the case where there is no room on the casting level around the casting mold to place a supply hopper close to said mold, and when the supply pipe 2 is inclined so that the flow of powder 9 thereinto is no regularly achieved by gravity from the hopper, then it is possible, without departing from the invention, to supply said supply pipe 2 by mechanical or pneumatical conveying means 12 (shown in FIG. 4). So that the end section 2*a* of supply pipe 2, just upstream of the delivery nozzle 1, is permanently supplied with powder and the downflow by gravity of the required quantity of power is achieved.

Figure 6:
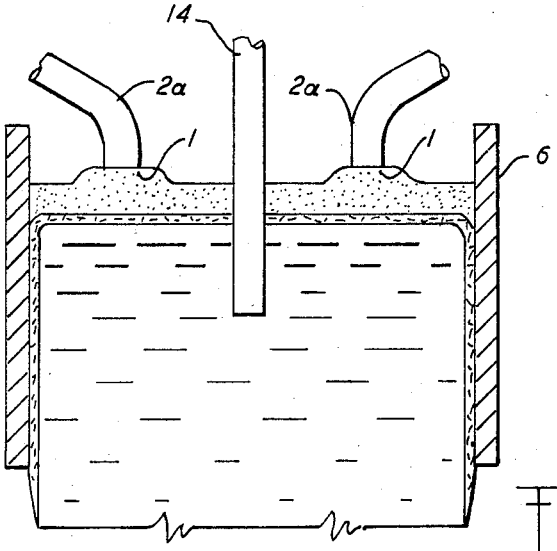
FIG. 6 is a longitudinal side view of the mold illustrated in FIG. 5, taken along line VI—VI thereof.
Figure 5:
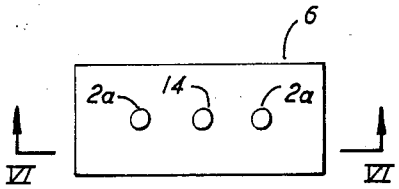
FIG. 5 is a schematic top view of a casting mold, showing an alternate arrangement for positioning the delivery and casting nozzles.
Figure 8:
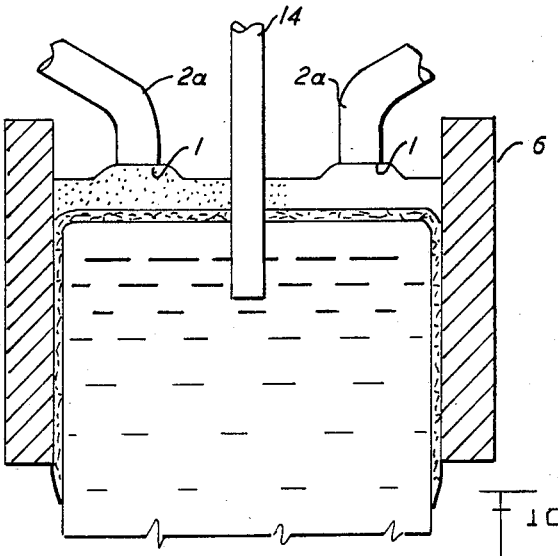
FIG. 8 is a transverse side view of the mold shown in FIG. 7, taken along line VIII—VIII thereof.
Figure 7:
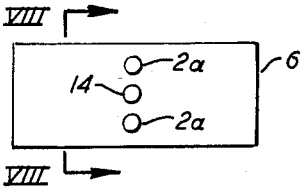
FIG. 7 is a schematic top view of a casting mold showing another arrangement for positioning the delivery and casting nozzles.

The method according to the invention is not limited to only one delivery nozzle 1. Indeed, as many such nozzles can be provided as necessary to appropriately cover the entire surface of the metal bath with the required thickness of powder. For example, only one delivery nozzle can be provided for a bloom or billet mold, and two delivery nozzles for slab ingot molds. In this last case, the delivery nozzles 1 (as shown in FIGS. 5 and 6) will be advantageously placed close to and on either side of the casting nozzle 14. The powder being supplied advantageously in the longitudinal plane of the mold. Alternately, a plurality of delivery nozzles 1 (as shown in FIGS. 7 and 8) may be placed close to and on either transverse side of the casting nozzle 14.

What is claimed is:

1. A method for maintaining a layer of powder material at a substantially even predetermined level above the surface of a metal bath in a continuous casting mold of the type where a liquid metal is conducted downward in a mold and the powder material is conducted through a supply pipe and onto a top surface of the metal, the supply pipe having a first end provided with a nozzle, the method comprising the steps of:

locating and maintaining the delivery nozzle at a level below top edges of the mold, and substantially at said predetermined level;

keeping the delivery nozzle open; and providing a continuous supply of powder to the first end of the supply pipe;

whereby as powder is conducted through the nozzle, mounds of powder temporariy collect immediately below the nozzle and temporarily stop the flow of powder therethrough; and as the liquid metal is conducted downward through the mold, powder spreads transversely outward from the nozzle, the level of powder on the metal bath falls below said predetermined level, and powder directly below the nozzle spreads outward to restart the powder flow through the nozzle and to raise the level of powder on the liquid metal toward said predetermined level.

2. Apparatus for continuously casting metal comprising:

a mold for maintaining a molten metal at a first level and conducting liquid metal downward therefrom; and means for maintaining a powder material at a second, predetermined, substantially even level above said first level including (i) a supply pipe, (ii) a delivery nozzle connected to a first end of the supply pipe and located at a level below top edges of the mold and substantially at said second level, the delivery nozzle having an outlet generally horizontal and parallel to said second level, and (iii) means for providing a continuous supply of powder to the first end of the supply pipe;

whereby as powder is conducted through the nozzle, mounds of powder temporarily collect immediately below the nozzle and temporarily stop the flow of powder therethrough; and as the liquid metal is conducted downward through the mold, powder spreads transversely outward from the nozzle, the level of powder on the metal bath falls below said predetermined level, and powder directly below the nozzle spreads outward to restart the powder flow through the nozzle and to raise the level of powder on the liquid metal toward said predetermined level.

3. Apparatus according to claim 2 wherein:

the mold includes a pair of spaced, longitudinally extending walls; and the delivery nozzle is located midway between said longitudinally extending walls.

4. Apparatus according to claim 2 wherein the means for providing the powder to the supply pipe includes a hopper supplying powder to the supply pipe by gravity.

5. Apparatus according to claim 2 wherein the means for providing the powder to the supply pipe includes:

a hopper; and conveyor means to carry powder from the hopper to the supply pipe.

6. Apparatus according to claim 2 comprising a plurality of delivery nozzles.

7. Apparatus according to claim 6 further comprising a casting nozzle for conducting liquid metal to the mold and wherein the mold has a longitudinal axis and the delivery nozzles are located adjacent to and on longitudinally opposite sides of the casting nozzle.

8. Apparatus according the claim 2 further comprising:

a plurality of delivery nozzles; and a casting nozzle to supply liquid metal to the mold; and wherein the mold includes a pair of spaced, longitudinally extending the walls; and the delivery nozzles are located midway between said longitudinally extending walls, and adjacent to and on longitudinally opposite sides of the casting nozzle.

9. A method of continuously casting steel comprising the steps of:

conducting a molten metal into and downward through a mold;

maintaining a top surface of the molten metal at a first preset level;

maintaining a layer of powder on the top surface of the molten metal at a substantially even second preset level, above the molten metal, by locating and maintaining a powder supply delivery nozzle at a level below top edges of the mold, and substantially at the second level, keeping the delivery nozzle open, and providing a continuous supply of powder to the delivery nozzle; and drawing powder toward walls of the mold to lubricate said walls;

whereby as powder is conducted through the nozzle, mounds of powder temporarily collect immediately below the nozzle and temporariy stop the flow of powder therethrough; and as the liquid metal is conducted downward through the mold, powder spreads transversely outward from the nozzle, the level of powder on the molten metal falls below said second level, and powder directly below the nozzle spreads outward to restart the powder flow through the nozzle and to raise the level of powder on the molten bath toward said second level.

* * * * *